US007088265B2

(12) United States Patent
Tsui et al.

(10) Patent No.: US 7,088,265 B2
(45) Date of Patent: Aug. 8, 2006

(54) SYSTEMS AND METHODS FOR PROXIMITY CONTROL OF A BARRIER

(76) Inventors: Gallen Ka Leung Tsui, 17 Sheard Avenue, Brampton, Ontario (CA) L6Y 1J3; Philip Y. W. Tsui, 17 Sheard Avenue, Brampton, Ontario (CA) L6Y 1J3

( * ) Notice: Subject to any disclaimer, the term of this patent is extended or adjusted under 35 U.S.C. 154(b) by 30 days.

(21) Appl. No.: 10/875,343

(22) Filed: Jun. 23, 2004

(65) Prior Publication Data

US 2005/0206497 A1 Sep. 22, 2005

Related U.S. Application Data

(60) Provisional application No. 60/554,725, filed on Mar. 18, 2004.

(51) Int. Cl.
*G08G 1/123* (2006.01)

(52) U.S. Cl. ..... 340/988; 340/539.13; 340/539.21; 340/539.23; 340/932.2

(58) Field of Classification Search ..... 340/539.11, 340/539.13, 539.21, 539.23, 932.2, 988; 701/200, 36; 455/456.1, 456.2, 73; 187/317; 49/25

See application file for complete search history.

(56) References Cited

U.S. PATENT DOCUMENTS 4,535,333 A 8/1985 Twardowski
4,623,887 A 11/1986 Welles, II
4,626,848 A 12/1986 Ehlers
4,771,283 A 9/1988 Imoto
4,825,200 A 4/1989 Evans et al.
4,878,052 A 10/1989 Schulze
4,905,279 A 2/1990 Nishio
4,928,098 A 5/1990 Dannhaeuser
4,959,810 A 9/1990 Darbee et al.
5,089,692 A 2/1992 Tonnesson
5,227,780 A 7/1993 Tigwell
5,379,453 A 1/1995 Tigwell
5,442,340 A 8/1995 Dykema
5,564,101 A 10/1996 Eisfeld et al.
5,600,324 A 2/1997 Reed et al.
5,619,190 A 4/1997 Duckworth et al.
5,661,804 A 8/1997 Dykema et al.
5,680,134 A 10/1997 Tsui
5,686,903 A 11/1997 Duckworth et al.
5,699,054 A 12/1997 Duckworth
5,699,055 A 12/1997 Dykema et al.
5,790,948 A 8/1998 Eisfeld et al.
5,793,300 A 8/1998 Suman et al.
5,815,086 A 9/1998 Ivie et al.
5,841,390 A 11/1998 Tsui
5,854,593 A 12/1998 Dykema et al.
5,903,226 A 5/1999 Suman et al.
5,923,758 A 7/1999 Khamharn et al.
5,969,637 A 10/1999 Doppelt et al.

(Continued)

*Primary Examiner*—Van T. Trieu
(74) *Attorney, Agent, or Firm*—Crowell & Moring LLP

(57) ABSTRACT

A system and method for proximity control of a barrier comprise a stationary wireless signal receiving device and a mobile transmitting device. The wireless signal receiving device may monitor at least one transmitting device within a predetermined coverage area and may be a radio frequency receiver or a spread spectrum receiver located near the barrier. In one embodiment, the transmitter device emits a control signal that is received by the receiving device when the transmitter is within a reception range. In one embodiment, the control signal includes transmitter identification information, directional information and position information.

37 Claims, 6 Drawing Sheets

U.S. PATENT DOCUMENTS 5,990,828 A 11/1999 King
6,005,508 A 12/1999 Tsui
6,008,735 A 12/1999 Chiloyan et al.
6,025,785 A 2/2000 Farris et al.
6,154,544 A 11/2000 Farris et al.
6,161,005 A * 12/2000 Pinzon ..... 455/403
6,169,492 B1 1/2001 Dabbish
6,243,000 B1 6/2001 Tsui
6,249,673 B1 6/2001 Tsui
6,327,570 B1 * 12/2001 Stevens ..... 705/7
6,359,558 B1 3/2002 Tsui
6,388,559 B1 5/2002 Cohen
6,414,545 B1 7/2002 Zhang
6,441,719 B1 8/2002 Tsui
6,556,813 B1 4/2003 Tsui
6,615,132 B1 * 9/2003 Nagasaka et al. ..... 701/200
6,634,408 B1 10/2003 Mays
6,684,062 B1 * 1/2004 Gosior et al. ..... 455/73
6,742,037 B1 5/2004 Hall et al.
6,823,188 B1 * 11/2004 Stern ..... 455/456.1
6,904,000 B1 6/2005 Lee
6,924,735 B1 * 8/2005 Ueda et al. ..... 340/426.28
6,980,117 B1 12/2005 Kirkland et al.
6,989,760 B1 1/2006 Dierking et al.
2003/0043021 A1 3/2003 Chung

* cited by examiner

FIG. 3
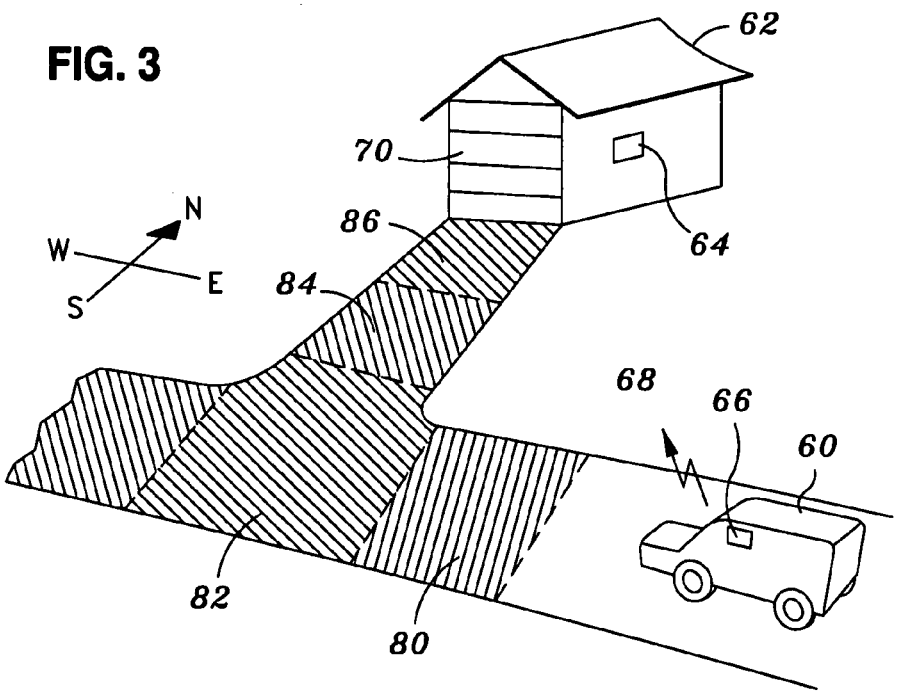
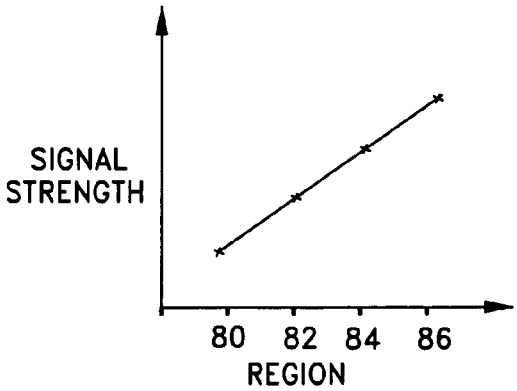
FIG. 4A
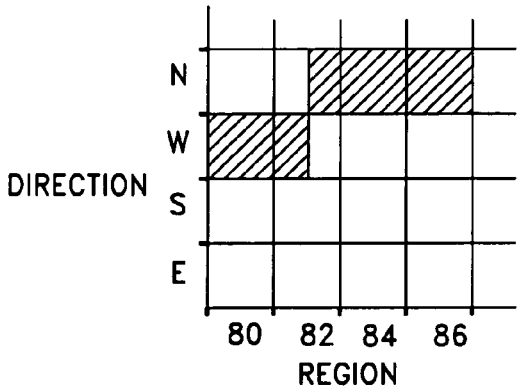
FIG. 4B

SYSTEMS AND METHODS FOR PROXIMITY CONTROL OF A BARRIER

CROSS REFERENCE TO RELATED APPLICATION

This application is related to and claims priority from the U.S. provisional patent application having application No. 60/554,725, filed on Mar. 18, 2004.

FIELD OF THE INVENTION

The invention relates in general to systems and methods for proximity control of a barrier. In particular, the proximate location of an object to a barrier is identified, and the barrier is actuated when one or more conditions are met.

BACKGROUND

Automatic barrier operators such as a garage door opener or gate opener are used in many homes. These operators typically require the activation of a wireless transmitter in order to open or close the barrier. However, there are times that users may forget to activate the operator to close the barrier. Alternatively, it may not be convenient or safe for the driver to remove his/her hands from the steering wheel to activate the wireless transmitter.

Conventional barrier operators include, for example, U.S. Pat. No. 6,476,732 which describes how an approaching vehicle can activate a garage door using a Global Positioning System (GPS). A similar system incorporating GPS technology is also described in U.S. Pat. No. 6,615,132. GPS may be used to locate an object on earth through communication with satellites. There are however, several disadvantages in using such technology. Although GPS systems are widely available, it is rather expensive to employ this technology for barrier control operation. Another disadvantage in implementing GPS technology for such use is accuracy. Most consumer-grade GPS receivers are accurate to only within 50 feet, which means that an error of up to 50 feet may be expected. For applications such as garage door control, such a range of error may be unacceptable. For example, if an authorized vehicle is approaching a driveway that is 40 feet long, the door may not open even if the vehicle is on the driveway, since the range of error is 50 feet. Moreover, most driveways are less than 50 feet long. There are other sources of errors such as signal multi-path, orbital errors, Ionosphere and troposphere delays, receiver clock errors etc. Therefore, there is a need for a system and method that overcomes these disadvantages.

BRIEF SUMMARY OF THE INVENTION

Disclosed and claimed herein are systems and methods for proximity control of a barrier. In one embodiment, a system comprises a transmitter to transmit a control signal which includes transmitter identification information, directional information and position information. The system further includes a receiver coupled to a barrier control device, where the receiver stores user-defined directional information and user-defined position information and receives a control signal from the transmitter. In one embodiment, the receiver also compares the directional information and position information in the control signal to the user-defined directional information and user-defined position information. If there is a match, the receiver actuates the barrier control device.

Other embodiments are disclosed and claimed herein.

BRIEF DESCRIPTION OF DRAWINGS

FIG. 3 is a diagram that illustrates the operation of one embodiment of the proximity barrier control system;

FIG. 4*a* is a diagram of one embodiment of the relationship between different regions and the respective signal strength of a specific path;

FIG. 4*b* is a diagram of one embodiment of the relationship between different regions and the respective directions of a specific path;

DETAILED DESCRIPTION OF THE PREFERRED EMBODIMENT

Figure 1:
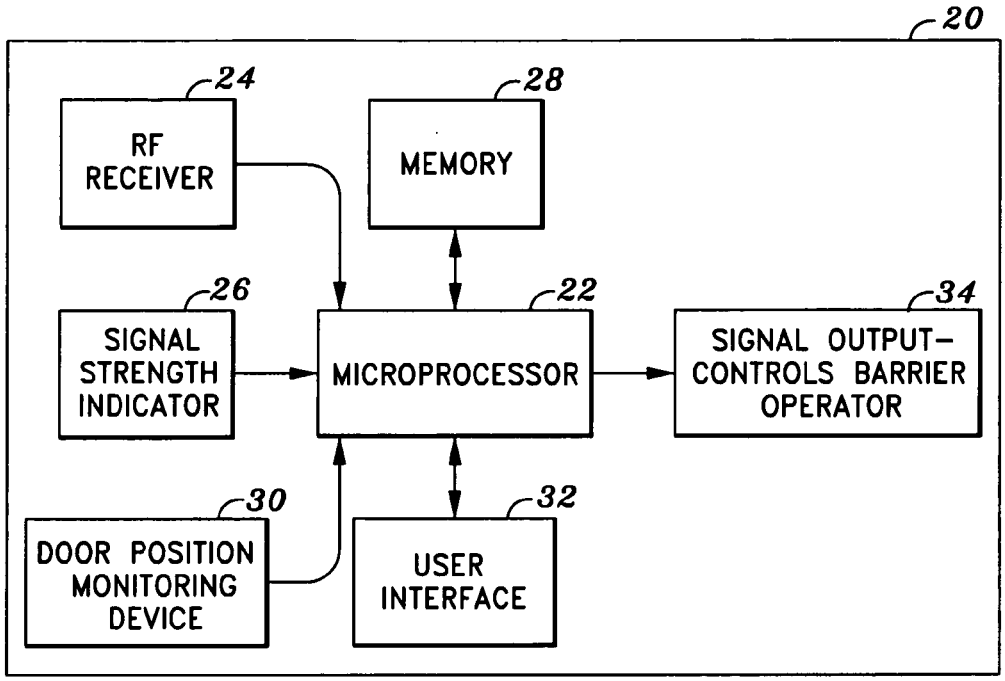
FIG. 1 is a general schematic diagram of one embodiment of the receiver unit in the proximity barrier control system, provided in accordance with the principles of the invention.

One aspect of the invention involves a proximity barrier control system that comprises a stationary wireless signal receiving device. The signal receiving device may monitor at least one transmitting device within a predetermined coverage area. Such a receiving device may be a radio frequency receiver located near the barrier. The transmitting device may be a radio frequency transmitter attached to a mobile object, such as a vehicle or person. Since the radio frequency receiver is fixed at one location, in one embodiment the only time that the receiver receives signals from the transmitter is when the transmitter is within the reception range. In one embodiment, a barrier control mechanism, to which the receiver may be coupled, actuates the barrier when the transmitter is in close proximity.

In another embodiment, spread spectrum technology may be implemented. Spread spectrum technology is a wireless communication protocol which allows more reliable communication than the traditional narrow band frequency technique typically implemented in most conventional garage door operators. Spread spectrum technology involves continuous signal transmission at high transmission strength. By implementing spread spectrum technology, multiple devices may also be operated within one operational range, i.e. multiple vehicles in the same neighborhood with the proximity barrier control can be used at the same time. With narrow band radio frequency, interference occurs, causing multiple systems in the same operational range to malfunction. The use of spread spectrum also eliminates the possibility of code duplication. Therefore, continuous monitoring and continuous communication between the transmitter and the receiver is possible, resulting in a higher degree of reliability and stability.

The invention may also include a signal strength indication device located at the receiver end and a direction indication device such as a compass, at the transmitter end. With the signal strength indication device, the receiver can tell not only whether the authorized object is within the reception range, but also how far the object is, based on the strength of the received signal. With the direction indication device (such as a compass), the receiver can determine whether an object (authorized or acknowledged by the transmitter) is traveling towards the receiver at the barrier, or away from the barrier. These additional features further enhance the reliability of the proximity barrier control.

Another aspect of the invention is a programming mode which allows the user to "train" the receiver to recognize the paths taken by the authorized object as it approaches and leaves the barrier. In one embodiment, the receiver has a memory device to memorize the signal strength and directional indication at various points along the path as the authorized object is approaching or leaving the barrier. During the operational mode, if these conditions cannot be met, the barrier will not be activated.

The invention can also be applied to control devices other than a barrier operator. For example, depending on whether the object (such as an authorized vehicle or person) is approaching or leaving the receiver, different actions or tasks can be assigned, such as turning on/off lights, arming/disarming security systems, changing the thermostat setting of heating/cooling system, locking/unlocking an electric deadbolt etc.

It should further be appreciated that the transmitting device and the receiving device may be equipped with Bluetooth technology. In such an embodiment, the only time that the receiver unit receives signals from the Bluetooth-equipped transmitter is when the Bluetooth-equipped transmitter is within the reception range of a Bluetooth-equipped receiver. In one embodiment, the Bluetooth-equipped transmitter is a cellular phone or PDA which transmits a Bluetooth signal on a continuous basis. Alternatively, the Bluetooth-equipped cellular phone or PDA may transmit the Bluetooth signal on an intermittent basis, when manually activated, or at predetermined times.

FIG. 1 is a schematic diagram of one embodiment of the receiver unit of the proximity barrier control system provided in accordance with the principles of the invention. The receiver unit 20 is provided with a microprocessor 22 which may comprise several different input and output ports to communicate with different modules within the receiver unit. Radio frequency receiver 24 provides the received signals to the microprocessor 22 for signal processing. In one embodiment, the receiver will operate based on spread spectrum technology. Such received signal may include the transmitter identity code, the directional information regarding where the authorized transmitter is heading etc. Signal strength indicator 26 may be used to provide additional information regarding the strength of the received signal. With this indicator 26, the microprocessor 22 can determine not only whether the authorized transmitter is within the predetermined range, but also how close the transmitter is from the receiver. Memory 28 may be used to store the identity code of the authorized transmitter, where each authorized transmitter has its own identity code. Memory 28 may also be used to store the received signal information during programming mode, which stores the signal strength and the directional information of an authorized transmitter as it is approaching or leaving the receiver.

The stored signal information can be used during the operation mode to verify whether the object (having the transmitter) is approaching or leaving the receiver along the predetermined path. A barrier position monitoring device 30 may be used to continuously monitor the position of the barrier. Examples of such garage door monitoring devices are disclosed in U.S. Pat. No. 6,597,291. Upon receiving information regarding the position of the barrier, the microprocessor 22 may determine whether it is necessary to open or close such a barrier when other conditions are met. User interface 32 such as an LED or a LCD display and buttons or keys as input devices are also necessary to input and display the current status of the unit. When the proper signal is received and other conditions are met, the microprocessor 22 will activate the barrier operator (not shown) through a signal output device 34, such as a relay.

Figure 2:
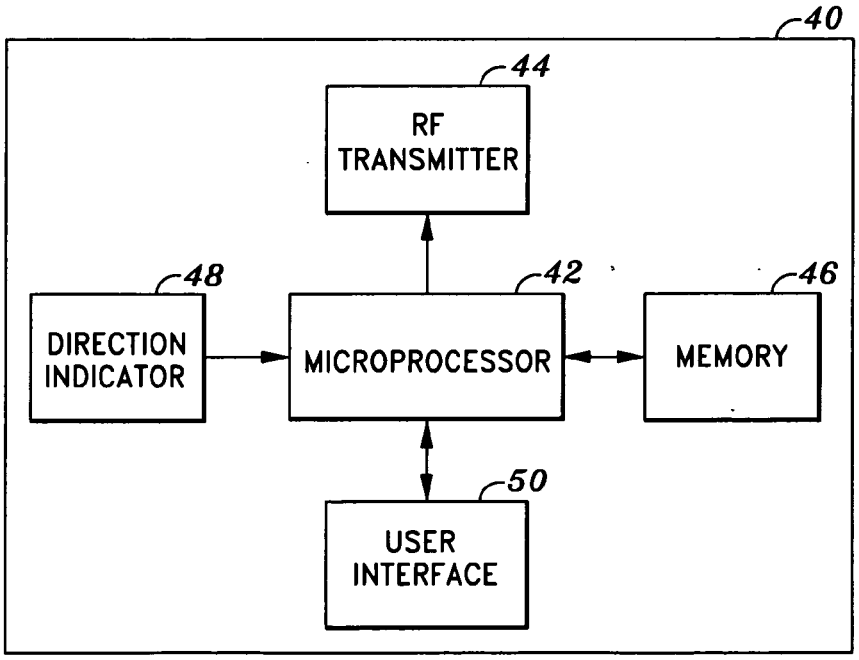
FIG. 2 is a general schematic diagram of one embodiment of the transmitter unit in the proximity barrier control system, provided in accordance with the principles of the invention.

FIG. 2 is a schematic diagram of one embodiment of the transmitting device 40. The transmitting device 40 comprises a microprocessor 42 which connects and communicates with different modules. Radio frequency transmitter 44 continuously transmits a signal when the transmitting device is powered up. In one embodiment, the transmitter operates based on spread spectrum technology to provide reliable communication. Alternatively, or in addition to, the transmitter may operate based on Bluetooth technology. A memory device 46 is used to store the transmitter identity code. Each transmitting device has its own identity code that may be programmed at the factory. A portion of the transmitted signal consists of the direction where the transmitter is heading. This directional information is determined by directional indicator 48. User interface 50 such as LED or LCD display and buttons or keys as input devices are also necessary to input and display the current status of the unit.

FIG. 3 illustrates one embodiment of the operation of the proximity barrier control system. In this figure, a proximity barrier control system (including receiver unit 64) has been installed to operate a garage door 70. In the embodiment of FIG. 3, vehicle 60 is traveling towards garage 62. Transmitter unit 66 is attached to vehicle 60 and continuously transmits control signal 68. This transmitter unit 66 has been programmed to the receiver unit 64, therefore, when it is in the reception range of the receiver unit 64, the receiver unit will recognize and process the transmitted signal (e.g., control signal 68).

Continuing to refer to FIG. 3, as the vehicle travels towards garage 62, it will first enter the reception region 80. In the embodiment of FIG. 3, there are 4 reception regions having different signal strength levels, with region 80 having the lowest signal strength. In this embodiment, the signal strengths of regions 82, 84 and 86 increase as one approaches the garage. As will be understood by one skilled in the art, a fewer or greater number of regions may similarly be specified.

Once vehicle 60 is within one of the specified reception regions (e.g., 80, 82, 84 and 86), the receiver will be able to receive a control signal from the transmitter. In one embodiment, this control signal includes related information, such as transmitter identification information, the signal strength and directional information. In this case, when the vehicle 60 is within reception region 80, the signal strength will be at its lowest level and the direction will be towards the West. As the vehicle continues to move towards the garage, it will enter region 82 where the signal strength will be higher than region 80, yet the directional information will remain the same as the region 80 (e.g., heading West). Once the vehicle 60 makes a right turn onto the driveway, the vehicle 60 will be heading north and the signal strength will again increase due to the fact that the vehicle 60 is now in region 84. At this point, the transmitter unit 66 will be transmitting a control signal 68 which indicates that both the directional information (i.e., vehicle 60 is heading North in the direction of the garage 62), and signal strength information (i.e., the vehicle 60 is on the driveway). As the vehicle continues up the driveway towards the garage 62, the signal strength will continue to increase. Based on the configuration of the illustrated garage and driveway, graphs may be plotted as shown in FIG. 4*a* and FIG. 4*b*. FIG. 4*a* shows that the signal strength increases from region 80 to region 86. FIG. 4*b* shows the direction of the vehicle as a function of the various reception regions.

In one embodiment, the invention allows users to program specific paths that will activate the proximity barrier control system under specific circumstances. If the authorized vehicle is traveling on a programmed path, the proximity barrier control system will either: (i) open the barrier if the authorized vehicle is approaching and in proximity of the barrier, or (ii) close the barrier if the authorized vehicle is leaving and has cleared the immediate area of the barrier.

In order to program user-specific paths, the microprocessor 22 of the receiver unit 20 may store the signal strength and directional information of the desired path into its memory 28 when the receiver unit is in the programming mode. During normal operation, if the signal strength and directional information of an object (such as an authorized vehicle) meets the stored criteria, the proximity barrier control may be activated to control the barrier in the desired manner.

Figure 5:
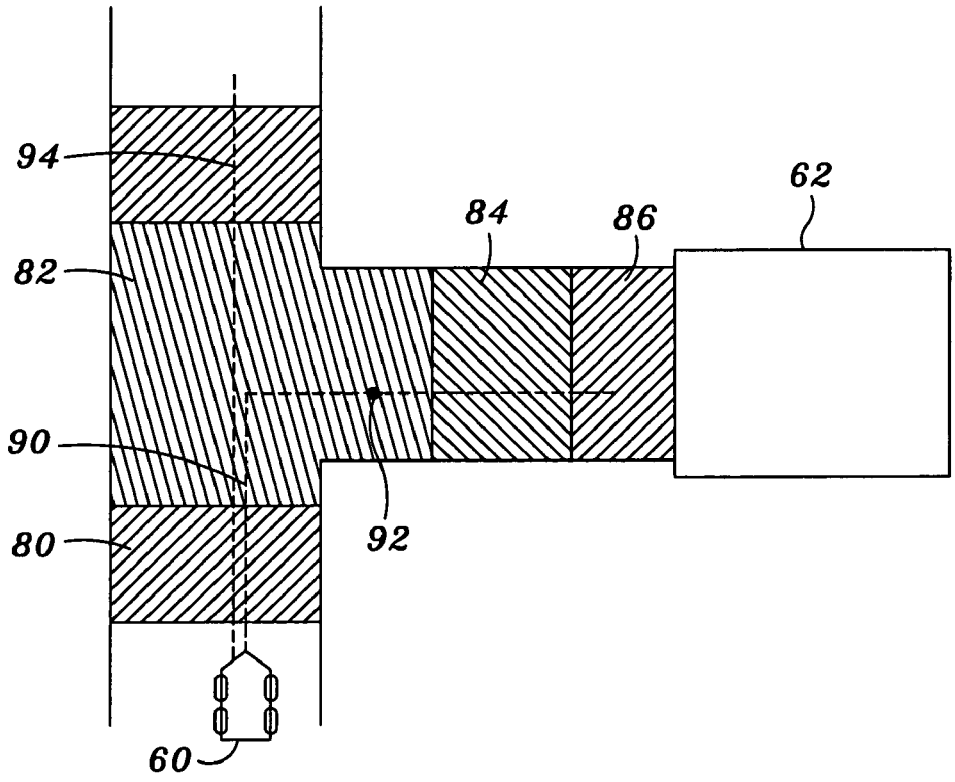
FIG. 5 is a top view of a diagram illustrating one embodiment of the door open operation of the invention.

FIG. 5 illustrates a top view of the garage and driveway configuration as shown in FIG. 3. The figure illustrates one embodiment of a door-open operation in accordance with the principles of the invention. In this embodiment, the user has already programmed one of the specific approaching paths as path 90, with location 92 being the point where the proximity barrier control system will be activated to open the garage door. In one embodiment, the vehicle 60 must travel along the predetermined path in order to meet the signal strength and directional requirements, meaning that the vehicle must turn onto the driveway for the garage door to be opened. If the vehicle 60 does not turn onto the driveway, the transmitter unit 66 will not provide the proper control signal 68 to the receiver unit 64, and the garage door 70 will not be actuated. For example, if a user travels along path 94 but decides not to go home and instead drives right by the driveway, the garage door 70 will not be actuated. Without directional verification, the garage door would have opened because the signal strength in region 82 is identical to that at location 92. Thus, in this embodiment even if the signal strength requirement is fulfilled, the garage door will open only if the directional condition is also met. Therefore, the advantage of having both signal strength and direction as verification conditions avoids the undesired situation of accidentally triggering the proximity barrier control system.

Figure 6:
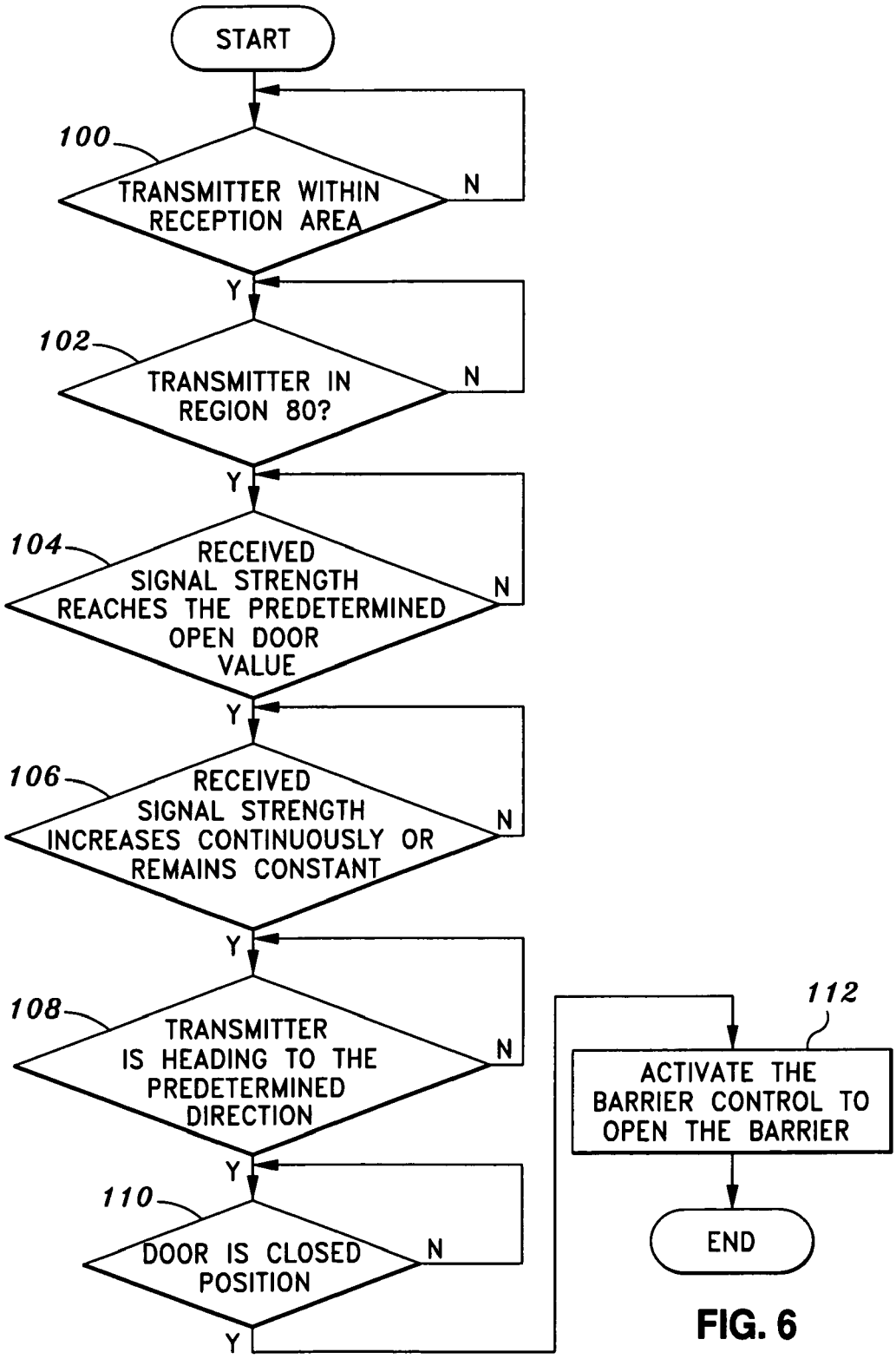
FIG. 6 is a flow chart illustrating one embodiment of the control flow of a door open sequence.

FIG. 6 is a flow chart illustrating one embodiment of the requirements for a door open sequence. At decision block 100 a determination is made as to whether an authorized transmitter (e.g., vehicle 60 with the transmitter unit 66) is within the signal reception range. If the authorized transmitter unit is within the signal reception range, the process continues to block 102 where a determination is made as to whether the authorized transmitter has just entered the signal reception range, such as region 80, or other regions. In one embodiment, in order to activate the door open sequence, the vehicle must enter the reception range from the lowest signal region, which is region 80. As the authorized transmitter (e.g., transmitter unit 66 of vehicle 60) travels towards the garage, the signal strength reaches the predetermined value as indicated as step 104, such as the signal strength at location 92. The barrier control will be activated with an additional condition specified as step 106 i.e., that the signal strength has not decreased throughout this process. The signal strength must be monitored closely to determine if the vehicle is really approaching the garage. If the signal strength decreases at one point, it may indicate that the driver of the vehicle intends to leave the reception area. The door open sequence will not proceed unless the signal strength is constantly increasing or remains constant. Step 108 determines whether the transmitter is heading towards the right direction. If so, the barrier control will be activated. The door will then be opened if the previous door position is closed, as shown as step 110.

Figure 7:
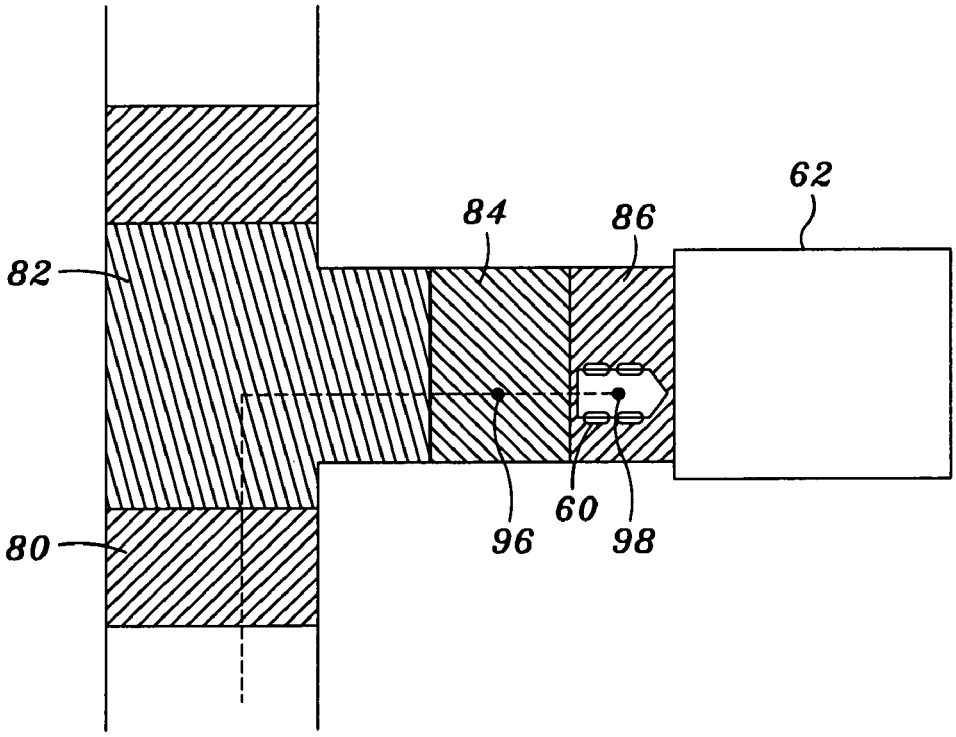
FIG. 7 is a top view diagram describing one embodiment of the door close operation of the invention.

FIG. 7 illustrates one embodiment of the door close sequence provide in accordance with the principles of the invention. In the figure, a garage and driveway configuration is shown with a vehicle leaving the garage. Location 96 is where the user has programmed the garage door to be closed. Therefore, the vehicle must be at a location that is closer to the garage than location 96 for activation to occur. Assuming the vehicle is originally parked at location 98, and it is now leaving the garage. The signal strength of the signal received by the receiver unit will decrease as the vehicle departs from the garage. When the vehicle reaches location 96 where the signal strength decreases to the predetermined value, and the direction of the vehicle remains the same as the predetermined direction, the door will be activated. Thus, the door will close if the previous door position is open.

Figure 8:
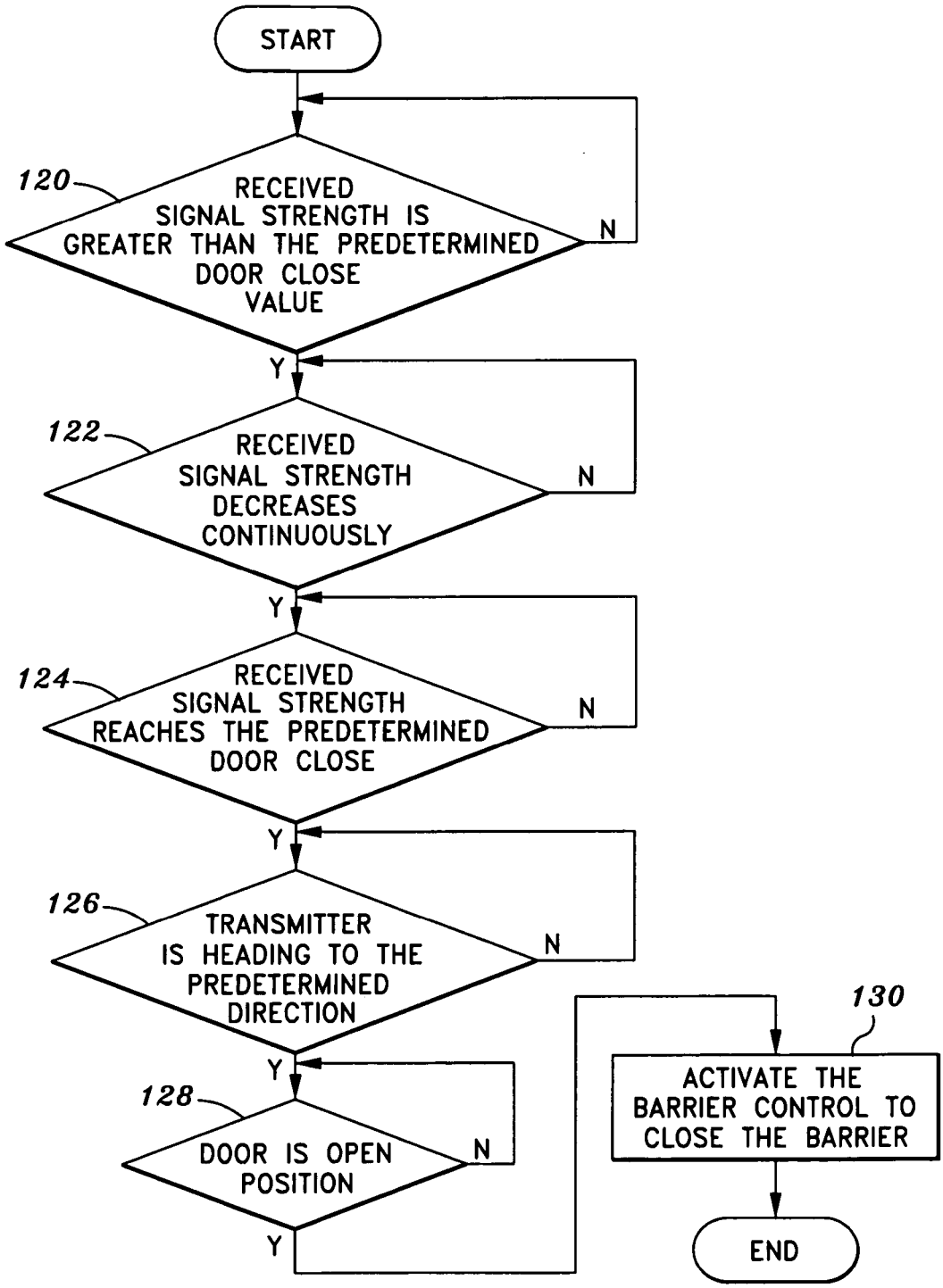
FIG. 8 is a flow chart illustrating one embodiment of the control flow of a door close sequence.

FIG. 8. is a flow chart illustrating one embodiment of the control flow of a door close sequence provides in accordance with the principles of the invention. Since the vehicle must leave the garage from a close proximity in order to activate the door close sequence, step 120 may be used to determine whether the vehicle 60 is in the close proximity of the garage. The vehicle must be closer to the garage than the predetermined door close value, so when it leaves the garage, the signal strength will decrease continuously until it reaches the predetermined door close signal strength as specified in step 122 and 124. At step 126, the direction of the vehicle is verified. If the vehicle is heading in the desired direction, the door will be activated by the barrier control. Thus, if the previous door position was open, the door will now close.

Besides controlling a barrier, the invention can also be used to control lighting, so when an authorized vehicle or person arrives home, lights can be turned on automatically. The same principle applies to wireless security which ensures that one has armed the system when one leaves one's property, or controlling the thermostat to automatically lower the preset temperature of the furnace in the winter to save energy. Therefore, the invention can be applied to control different electronic devices.

The invention may also be implemented in before-market and after-market applications. In before-market applications, the transmitting unit can be built-into the vehicles, to provide power and the directional information to the user. The receiving unit can also be built-into a desired device, such as a garage door opener or gate opener.

After-market applications for using the barrier control may also be implemented. This requires simple installation by the user, in mounting the transmitting unit to the vehicle and the receiving unit inside the garage.

While the preceding description has been directed to particular embodiments, it is understood that those skilled in the art may conceive modifications and/or variations to the specific embodiments described herein. Any such modifications or variations which fall within the purview of this description are intended to be included herein as well. It is understood that the description herein is intended to be illustrative only and is not intended to limit the scope of the invention.

What is claimed is:

1. A system comprising:

a transmitter to transmit a control signal including transmitter identification information and position information; and, a receiver coupled to a barrier control device, said receiver to, store user-defined position information, receive said control signal from said transmitter, compare the position information in said control signal to said user-defined position information, and if there is a match, actuate the barrier control device.

2. The system of claim 1 wherein said control signal further includes directional information and said receiver is further to, store user-defined directional information, and compare both the directional information and the position information in said control signal to said user-defined directional information and user-defined position information, and if there is a match, actuate the barrier control device.

3. The system of claim 2 wherein said user-defined directional information and user-defined position information is programmable into a memory of said receiver during a program mode.

4. The system of claim 2 wherein said user-defined directional information includes a plurality of direction values corresponding to directions of movement for said transmitter, and said user-defined position information includes a plurality of position values corresponding to positions of said transmitter for each of a plurality of reception regions.

5. The system of claim 4 wherein said plurality of position values are defined by signal strengths of said control signal for each of said plurality of reception regions, said signal strength to be detectable by a signal strength indicator of said receiver.

6. The system of claim 4 wherein said plurality of position values are defined by spread spectrum position signals for each of said plurality of reception regions.

7. The system of claim 1 wherein said control signal is one of a radio frequency signal and a spread spectrum signal.

8. The system of claim 7 wherein said spread spectrum signal is a Bluetooth signal.

9. The system of claim 1 wherein said transmitter identification information includes a transmitter ID code, and said receiver is further to compare said transmitter ID code in said control signal to a pre-programmed transmitter ID code in a memory of said receiver.

10. The system of claim 1 wherein said transmitter transmits said control signal on a continuous basis, said transmitter to be coupled to a mobile object.

11. The system of claim 10 wherein said mobile object is a vehicle and said barrier control device is a garage door opener.

12. The system of claim 1 further comprising a barrier position monitor to detect a barrier position of said barrier, and wherein said receiver actuates said barrier control device based on said comparison of said position information to said user-defined position information, as well as on said barrier position.

13. The system of claim 1 wherein said transmitter and receiver are equipped with Bluetooth technology, and said control signal is a Bluetooth signal.

14. The system of claim 13 wherein said transmitter is one of a cellular telephone and a personal digital assistant.

15. A method comprising:

storing user-defined position information in a memory of a receiver, said receiver to be coupled to a barrier control device;

transmitting a control signal by a transmitter, said control signal including transmitter identification information and position information;

receiving said control signal by a receiver;

comparing, by said receiver, the position information in said control signal to said user-defined position information, and, if there is a match, actuating the barrier control device.

16. The method of claim 15 further comprising:

storing user-defined directional information in said memory;

transmitting the control signal where said control signal includes said transmitter identification information, said position information and directional information;

comparing, by said receiver, both the position information and the directional information in said control signal to said user-defined position information and said user-defined directional information, and, if there is a match, actuating the barrier control device.

17. The method of claim 15 wherein transmitting said control signal by the transmitter comprises transmitting one of a radio frequency control signal and a spread spectrum control signal.

18. The method of claim 17 wherein said comparing comprises comparing, by said receiver, the directional information and position information in said control signal to said user-defined directional information and user-defined position information, where said user-defined directional information includes a plurality of direction values corresponding to directions of movement for said transmitter, and said user-defined position information includes a plurality of position values corresponding to positions of said transmitter for each of a plurality of reception regions.

19. The method of claim 18 wherein said plurality of position values are defined by signal strengths of said control signal for each of said plurality of reception regions, said signal strength to be detectable by a signal strength indicator of said receiver.

20. The method of claim 18 wherein said plurality of position values are defined by spread spectrum position signals for each of said plurality of reception regions.

21. The method of claim 15 wherein transmitting said control signal by the transmitter comprises transmitting a Bluetooth signal.

22. The method of claim 15 wherein transmitting said control signal by the transmitter, comprises transmitting said control signal where said transmitter identification information is a transmitter ID code, and the method further comprises comparing said transmitter ID code in said control signal to a pre-programmed transmitter ID code.

23. The method of claim 15 further comprising transmitting said control signal by said transmitter on a continuous basis where said transmitter is coupled to a mobile object.

24. The method of claim 23 wherein said transmitting said control signal comprises transmitting said control signal by said transmitter on a continuous basis where said transmitter is coupled to a vehicle and said barrier control device is a garage door opener.

25. The method of claim 15 further comprising:

monitoring a barrier position of said barrier;

comparing said position information to said user-defined position information; and actuating said barrier based on said comparing and on said barrier position.

26. The method of claim 15 further comprising transmitting said control signal by said transmitter where said transmitter and receiver are equipped with Bluetooth technology and said control signal is a Bluetooth signal.

27. The method of claim 26 wherein said transmitting said control signal comprises transmitting said control signal by said transmitter on a continuous basis where said transmitter is one of a cellular telephone and a personal digital assistant.

28. A receiver unit coupled to a barrier control device, the receiver unit comprising:

a processor;

a signal strength indicator coupled to the processor;

a receiver coupled to the processor; and, a memory coupled to the processor, said memory to include instruction sequences to cause the processor to, store user-defined signal strength information in said memory during a program mode, receive a control signal from a transmitter unit using the receiver, said control signal to have a signal strength and to include transmitter identification information, compare the signal strength of said control signal to said user-defined signal strength information, and if there is a match, actuate the barrier control device.

29. The receiver unit of claim 28 wherein said control signal further includes directional information, said memory to further include instruction sequences to cause the processor to, store user-defined directional information in said memory during the program mode, and compare both the signal strength and the directional information of said control signal to said user-defined directional information and user-defined signal strength information, and if there is a match, actuate the barrier control device.

30. The receiver unit of claim 28 wherein said transmitter identification information includes a transmitter ID code, and said receiver unit is further to compare said transmitter ID code in said control signal to a pre-programmed transmitter ID code.

31. The receiver unit of claim 28 wherein said transmitter unit transmits said control signal on a continuous basis and is coupled to a mobile object.

32. The receiver unit of claim 31 wherein said mobile object is a vehicle and said barrier control device is a garage door opener.

33. The receiver unit of claim 29 wherein said user-defined directional information includes a plurality of direction values corresponding to directions of movement for said transmitter unit, and said user-defined signal strengths includes a plurality of signal strengths corresponding to signal strengths of said control signal for each of a plurality of reception regions.

34. The receiver unit of claim 33 wherein said reception regions are proximately located to the receiver unit and the barrier control device, and wherein the signal strengths of said control signal increases as the transmitter unit approaches said receiver unit such that said control signal will have a different strength depending in which of said plurality of reception regions the transmitter unit is located.

35. The receiver unit of claim 28 wherein said receiver unit is coupled to a barrier position monitor that detects a barrier position of said barrier, and wherein said receiver actuates said barrier control device based on said comparison of said strength information to said user-defined strength information, as well as on said barrier position.

36. The receiver unit of claim 28 wherein said control signal is a radio frequency signal and a spread spectrum signal.

37. The receiver unit of claim 36 wherein said spread spectrum signal is a Bluetooth signal.

* * * * *